US010939197B2

(12) United States Patent
Fang

(10) Patent No.: US 10,939,197 B2
(45) Date of Patent: Mar. 2, 2021

(54) SOUND RECEIVING ELECTRONIC DEVICE AND SOUND RECEIVING STRUCTURE THEREOF

(71) Applicant: PEGATRON CORPORATION, Taipei (TW)

(72) Inventor: Yu-Lin Fang, Taipei (TW)

(73) Assignee: PEGATRON CORPORATION, Taipei (TW)

( * ) Notice: Subject to any disclaimer, the term of this patent is extended or adjusted under 35 U.S.C. 154(b) by 0 days.

(21) Appl. No.: 16/523,469

(22) Filed: Jul. 26, 2019

(65) Prior Publication Data

US 2020/0059722 A1 Feb. 20, 2020

(30) Foreign Application Priority Data

Aug. 20, 2018 (TW) ..... 10721141.9

(51) Int. Cl.
*H04R 1/04* (2006.01)
*H04R 1/34* (2006.01)
*H04R 3/00* (2006.01)

(52) U.S. Cl.
CPC ..... *H04R 1/342* (2013.01); *H04R 3/00* (2013.01); *H04R 2201/003* (2013.01)

(58) Field of Classification Search
CPC . H04R 3/00; H04R 1/342; H04R 1/04; H04R 19/04; H04R 19/005; H04R 2201/003; H04R 7/16
USPC .... 381/91–92, 355, 361, 365, 360, 111, 113, 381/357, 122, 174
See application file for complete search history.

(56) References Cited

U.S. PATENT DOCUMENTS

| | | | | |
|---|---|---|---|---|
| 8,295,528 | B2 * | 10/2012 | Rombach | H04R 19/00 381/369 |
| 8,509,459 | B1 * | 8/2013 | Isvan | H04R 19/016 381/113 |
| 9,078,063 | B2 * | 7/2015 | Loeppert | H04R 1/04 |
| 10,051,355 | B2 * | 8/2018 | Zoellin | H05K 1/0296 |
| 10,277,983 | B2 * | 4/2019 | Yoo | H04R 19/04 |
| 10,362,378 | B2 * | 7/2019 | Doi | H04R 19/04 |

(Continued)

FOREIGN PATENT DOCUMENTS

| | | | |
|---|---|---|---|
| KR | 10-0650280 | B1 | 11/2006 |
| KR | 10-2010-0065123 | A | 6/2010 |
| KR | 10-2014-0135256 | A | 11/2014 |

*Primary Examiner* — Disler Paul
(74) *Attorney, Agent, or Firm* — Muncy, Geissler, Olds and Lowe, P.C.

(57) ABSTRACT

A sound receiving structure is applied to a sound receiving electronic device to receive a sound, wherein the sound receiving electronic device includes a housing defines a housing hole. The sound receiving structure includes a circuit board and an accommodating structure. The circuit board includes a plate, a sound guiding tube and a microphone. The plate defines a circuit board hole. The sound guiding tube is provided above the plate and located in the housing hole and includes a sound guiding hole aligned with the circuit board hole, wherein a diameter of the circuit board hole is smaller than a diameter of the sound guiding hole. The microphone is provided below the plate and corresponds in position to the circuit board hole. A sound passes through the sound guiding hole and the circuit board hole and then enters the microphone.

14 Claims, 4 Drawing Sheets

(56) References Cited

U.S. PATENT DOCUMENTS

2005/0018864 A1* 1/2005 Minervini ..... B81B 7/0064
381/175
2008/0123891 A1* 5/2008 Kato ..... H05K 1/141
381/361
2009/0034777 A1* 2/2009 Nho ..... H04R 1/023
381/386
2012/0250925 A1* 10/2012 Lillelund ..... H04R 19/016
381/355
2013/0070950 A1* 3/2013 Chen ..... H04R 1/222
381/353
2015/0373446 A1* 12/2015 Chen ..... H04R 19/005
381/111
2018/0242065 A1* 8/2018 Doi ..... H04R 19/04

* cited by examiner

SOUND RECEIVING ELECTRONIC DEVICE AND SOUND RECEIVING STRUCTURE THEREOF

BACKGROUND

Technology Field

The present disclosure relates to a sound receiving structure and a sound receiving electronic device using the sound receiving structure; more particularly, the present disclosure relates to a sound receiving structure that can be readily assembled without affecting the sound reception quality.

Description of the Prior Art

In a smart sound receiving electronic device, a microphone is installed in the sound receiving electronic device to receive a voice instruction of a user. Thus, the smart sound receiving electronic device performs a corresponding response or action in response to the voice instruction. As shown in FIG. 1, a sound receiving electronic device includes a housing 500, a sound guiding tube 600, a circuit board 700 and an accommodating case 900. The housing 500 is an outer housing of the sound receiving electronic device and has a housing hole 510. The sound guiding tube 600 is provided below the housing hole 510 and has a sound guiding hole 610 aligned with the housing hole 510. The circuit board 700 is located below the sound guiding tube 600 and has a circuit board hole 710 and a microphone 720, wherein the circuit board hole 710 is aligned with the sound guiding hole 610 and the microphone 720. The accommodating case 900 is joined with the housing 500, and an accommodating space is formed between the accommodating case 900 and the housing 500 to accommodate the sound guiding tube 600 and the circuit board 700. With the above structure, a sound can sequentially pass through the housing hole 510, the sound guiding hole 610 and the circuit board hole 710 and be transmitted to the microphone 720. The sound received by the microphone 720 is analyzed and processed by electronic components on the circuit board 700 for the smart sound receiving electronic device to perform a corresponding response or action.

When the housing 500, the sound guiding tube 600 and the circuit board 700 are assembled, the three holes, namely, the housing hole 510, the sound guiding hole 610 and the circuit board hole 710, need to be aligned with one another in order to form a complete sound receiving channel. To readily align the housing hole 510, the sound guiding hole 610 and the circuit board hole 710, the size of the sound guiding hole 610 is designed to be larger than that of the housing hole 510, and the size of the housing hole 510 is designed to be larger than that of the circuit board hole 710. However, an ideal structure of a sound receiving channel should gradually decrease in size from an outer end to an inner end to prevent distortion of the sound received. Thus, if the size of the sound guiding hole 610 is designed to be larger than that of the housing hole 510, the sound received can be distorted by the large-sized sound guiding hole 610 such that the sound reception quality of the microphone 720 is undesirably affected. Furthermore, in a conventional sound receiving electronic device, the sound guiding tube 600 is closely adhered below the housing 500; however, wind shear sounds generated due to insufficient airtightness between the sound guiding tube 600 and the housing 500 can result in interference of the sound reception quality.

Therefore, there is a need for a sound receiving structure that can be readily assembled without affecting the sound reception quality of a microphone.

SUMMARY OF THE DISCLOSURE

It is a primary object of the present disclosure to provide a sound receiving structure that can be readily assembled without affecting the sound reception quality and to provide a sound receiving electronic device using the sound receiving structure.

To achieve the above object, a sound receiving electronic device of the present disclosure includes a housing and a sound receiving structure. The housing includes a housing hole. The sound receiving structure is applied to receive a sound and includes a circuit board and an accommodating structure. The circuit board includes a plate, a sound guiding tube and a microphone. The plate includes a circuit board hole. The sound guiding tube is provided above the plate and located in the housing hole, and the sound guiding tube includes a sound guiding hole aligned with the circuit board hole, wherein a diameter of the circuit board hole is smaller than a diameter of the sound guiding hole. The microphone is provided below the plate and corresponds in position to the circuit board hole. A sound can pass through the sound guiding hole and the circuit board hole and then enter the microphone. The accommodating structure is fastened to the housing, and an accommodating space is formed between the accommodating structure and the housing to accommodate the circuit board.

According to an embodiment of the present disclosure, a diameter of the sound guiding tube is equal to a diameter of the housing hole.

According to an embodiment of the present disclosure, the sound receiving structure further includes a blocking fabric, which is connected to the housing and covers the housing hole.

According to an embodiment of the present disclosure, the sound receiving structure further includes a first buffer member, which is located between the circuit board and the housing.

According to an embodiment of the present disclosure, the sound receiving structure further includes a second buffer member, the accommodating structure further includes an accommodating structure bottom surface, and the second buffer member is located between the accommodating structure bottom surface and the circuit board.

According to an embodiment of the present disclosure, the second buffer member further includes a recess in which the microphone is located.

According to an embodiment of the present disclosure, the sound guiding tube is connected above the plate by an adhesive.

According to an embodiment of the present disclosure, the accommodating structure further includes an accommodating structure fastening hole and an accommodating structure fastening rod, the housing further includes a housing fastening portion, and the accommodating structure fastening rod passes through the accommodating structure fastening hole and is fastened to the housing fastening portion.

DETAILED DESCRIPTION OF THE EMBODIMENTS

Figure 1:
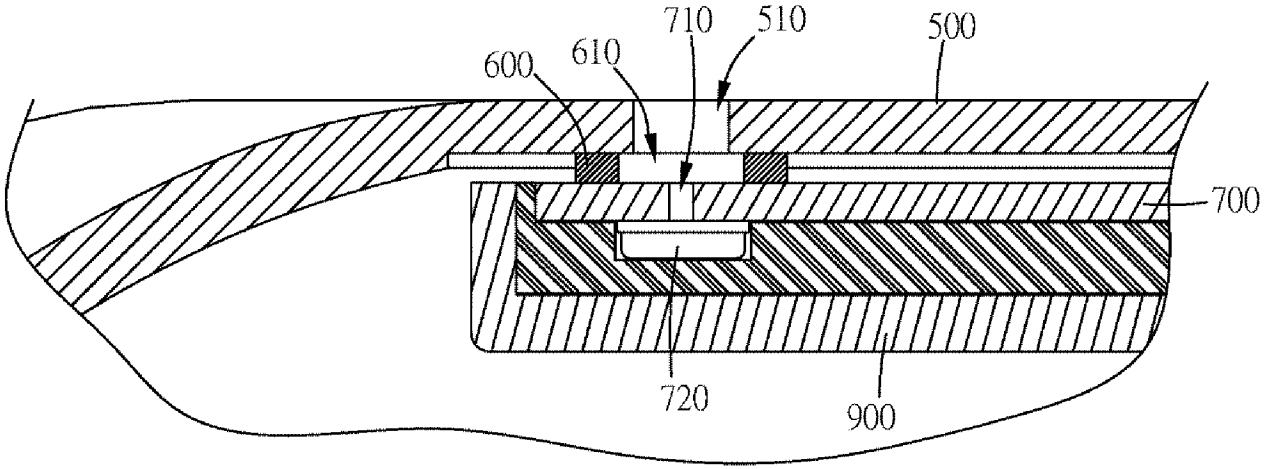
FIG.1 (Prior Art)
FIG. 1 illustrates a partial cross-sectional diagram of a sound receiving electronic device of the prior art.
Figure 2:
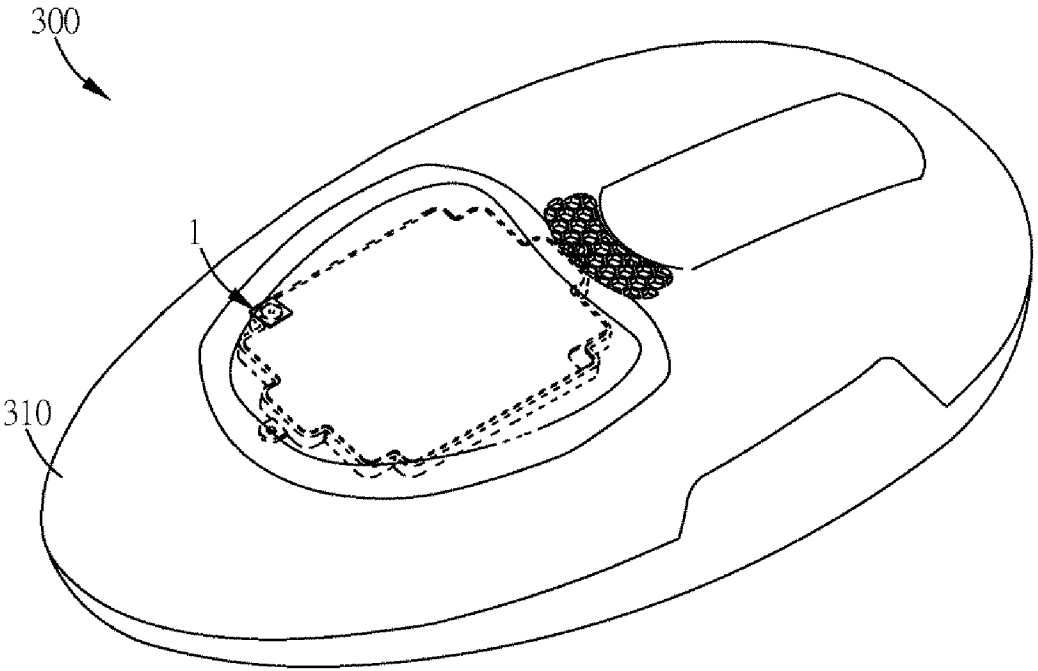
FIG. 2 illustrates a schematic diagram of a sound receiving electronic device according to an embodiment of the present invention.
Figure 3:
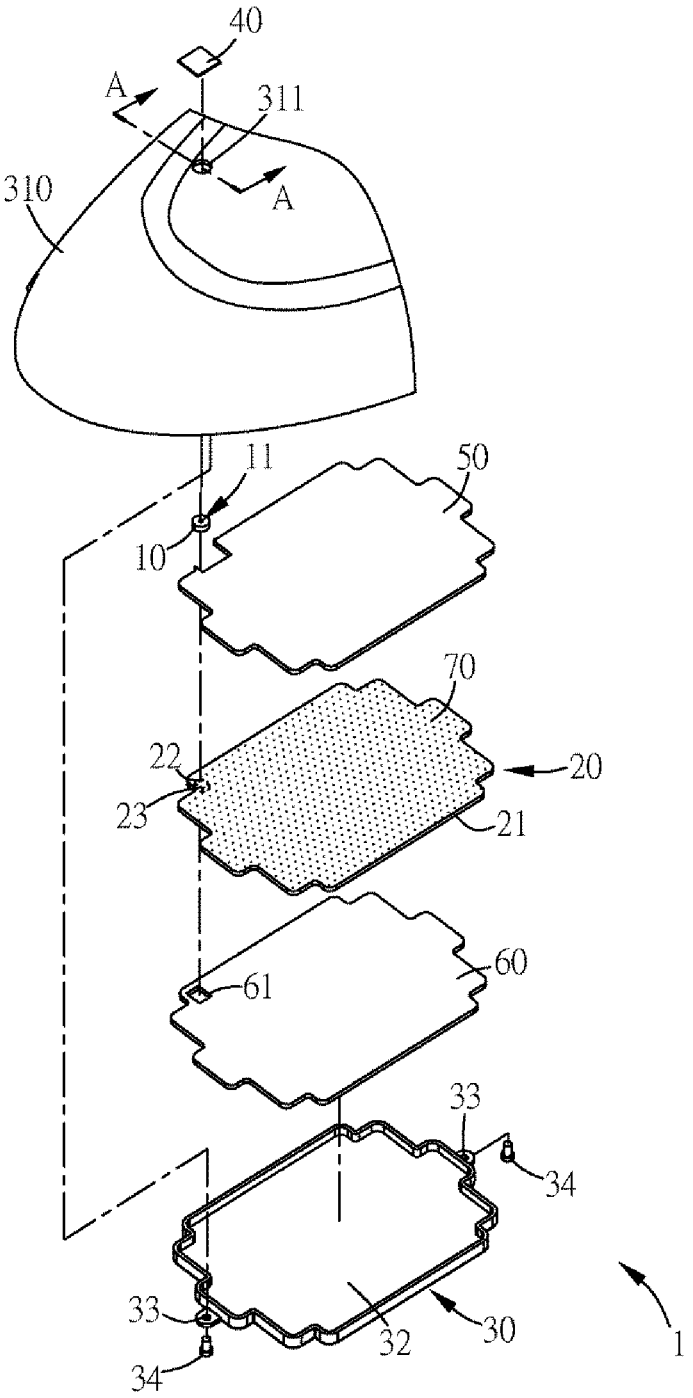
FIG. 3 illustrates an exploded perspective diagram of a sound receiving structure according to an embodiment of the present invention.
Figure 4:
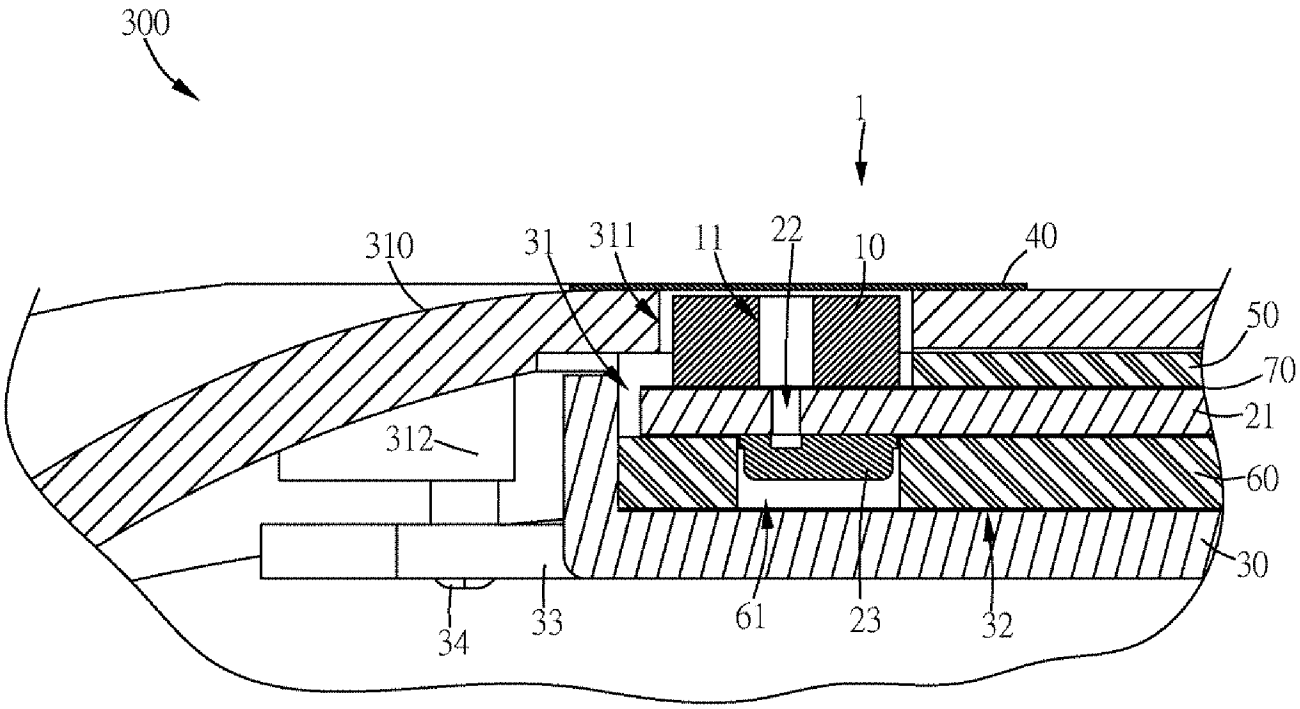
FIG. 4 illustrates a partial cross-sectional diagram of a sound receiving electronic device and a sound receiving structure along the section line AA in FIG. 3 according to an embodiment of the present invention.

Refer to FIG. 2 to FIG. 4, which illustrate a sound receiving structure according to an embodiment of the present invention. FIG. 2 illustrates a schematic diagram of a sound receiving electronic device according to an embodiment of the present invention. FIG. 3 illustrates an exploded perspective diagram of a sound receiving structure according to an embodiment of the present invention. FIG. 4 illustrates a partial cross-sectional diagram of a sound receiving electronic device and a sound receiving structure along the section line AA in FIG. 3 according to an embodiment of the present invention.

As shown in FIG. 2 to FIG. 4, in one embodiment of the present invention, a sound receiving structure 1 is applied to a sound receiving electronic device 300 to receive a sound. The sound receiving electronic device 300 includes a housing 310 which includes a housing hole 311 and includes two housing fastening portions 312. The housing fastening portion 312 is, for example, a screw hole structure. The sound receiving structure 1 includes a circuit board 20, an accommodating structure 30, a blocking fabric 40, a first buffer member 50, a second buffer member 60 and an adhesive layer 70.

As shown in FIG. 3 and FIG. 4, in one embodiment of the present invention, the circuit board 20 includes a sound guiding tube 10, a plate 21 and a microphone 23. The plate 21 includes a circuit board hole 22, which has a diameter ranging between 0.5 and 0.8 mm. However, the range of the diameter of the circuit board hole 22 is not limited to the above example and can be modified to be between 0.6 and 0.7 mm. The sound guiding tube 10 is provided above the plate 21 and located in the housing hole 311 and has a diameter equal to a diameter of the housing hole 311, such that the sound guiding tube 10 and the housing hole 311 can be fastened to each other. The sound guiding tube 10 is for transmitting a sound into the sound receiving electronic device 300. The sound guiding tube 10 includes a sound guiding hole 11, which is aligned with the circuit board hole 22. The diameter of the circuit board hole 22 is smaller than a diameter of the sound guiding hole 11, and the range of the diameter of the sound guiding hole 11 is between 1.1 and 1.6 mm. However, the range of the diameter of the sound guiding hole 11 is not limited to the above example and can be modified to be between 1.2 and 1.5 mm. The microphone 23 is provided below the plate 21 and corresponds in position to the circuit board hole 21. The sound passes through the sound guiding hole 11 and the circuit board hole 22 and then enters the microphone 23. Since the diameter of the circuit board hole 22 is smaller than the diameter of the sound guiding hole 11, such structure does not cause sound distortion and can thus maintain the sound reception quality of the microphone 23.

In one embodiment of the present invention, the accommodating structure 30 is fastened to the housing 310. An accommodating space 31 is formed between the accommodating structure 30 and the housing 310 and accommodates the circuit board 20, the first buffer member 50, the second buffer member 60 and the adhesive layer 70. The accommodating structure 30 includes an accommodating structure bottom surface 32, two accommodating structure fastening holes 33 and two accommodating structure fastening rods 34. The accommodating structure fastening rod 34 is, for example, a screw. The accommodating structure fastening rods 34, which are in the form of screws, pass through the accommodating structure fastening holes 33 and are fastened to the housing fastening portions 312, which are in the form of screw hole structures, thereby securely fastening the accommodating structure 30 to the housing 310. It should be noted that, although a position of only one housing fastening portion 312 is depicted in the drawings, according to positions of the two accommodating structure fastening holes 33 in FIG. 3, a person skilled in the art could easily understand that the positions of the two housing fastening portions 312 respectively correspond to the two accommodating structure fastening holes 33.

In one embodiment of the present invention, the blocking fabric 40 is an elastic fabric providing a decorative function and allowing the sound to pass through. The blocking fabric 40 is connected to the housing 310 and covers the housing hole 311 so as to prevent the housing hole 311 from being seen by a user and thus from affecting an aesthetic appearance.

In one embodiment of the present invention, the first buffer member 50 is, for example, a rubber piece. The first buffer member 50 is located between the circuit board 20 and the housing 310 and provides a buffer function to prevent mutual collision among components and hence from generating noise. Moreover, the first buffer member 50 can also absorb sounds entering from the gap between the sound guiding tube 10 and the housing hole 311 so as to prevent undesired entering sounds from affecting the sound reception quality.

In one embodiment of the present invention, the second buffer member 60 is, for example, a rubber piece. The second buffer member 60 is located between the accommodating structure bottom surface 32 and the circuit board 20. The second buffer member 60 includes a recess 61, in which the microphone 23 is located. The second buffer member 60 provides a buffer function to prevent mutual collision among components and hence from generating noise. Moreover, the second buffer member 60 can also absorb sounds entering from the gaps between the sound guiding tube 10, the housing hole 311 and the circuit board 20 so as to prevent undesired entering sounds from affecting the sound reception quality.

In one embodiment of the present invention, the adhesive layer 70 is, for example, a double-sided adhesive tape and covers the circuit board 20 (as a dotted region shown on the circuit board 20 in FIG. 3). The sound guiding tube 10 is connected above the plate 21 by using the adhesive layer 70. The adhesive layer 70 enables the sound guiding tube 10 to be securely joined with the plate 21. It should be noted that the adhesive layer 70 on the circuit board 20 does not cover the circuit board hole 22; by this design, the sound is prevented from being transmitted to the microphone 23.

To assemble the sound receiving structure 1 of the present invention, a double-sided adhesive tape (not shown) is first applied to the bottom of the sound guiding tube 10, and the adhesive layer 70 is applied to the plate 21. Next, one side of the sound guiding tube 10 with the double-sided adhesive tape applied is placed on the adhesive layer 70, and the sound guiding hole 11 is aligned with the circuit board hole 22, hence completing the sound receiving channel for transmitting a sound. Then the first buffer member 50 is placed on the adhesive layer 70, and the sound guiding tube 10 is placed in the housing hole 311 such that the first buffer member 50 is located between the circuit board 20 and the housing 310 to provide a buffer effect and to absorb noise. The second buffer member 60 is then placed on the accommodating structure bottom surface 32 of the accommodating structure 30 such that the second buffer member 60 covers the bottom of the circuit board 20 and the microphone 23 is located in the recess 61; by this design, the second buffer member 60 provides a buffer effect and absorbs noise. Next, the accommodating structure fastening rods 34 in the form of screws are passed through the respective accommodating structure fastening holes 33 and are fastened to the respective corresponding housing fastening portions 312 in the form of screw hole structures so as to securely fasten the accommodating structure 30 to the housing 310. Finally, the blocking fabric 40 is arranged to cover the housing hole 311 to prevent the housing hole 311 and the sound guiding tube 10 from affecting the aesthetic appearance, and the assembly process of the sound receiving structure 1 is thus completed.

With the design of the sound receiving structure 1 of the present invention, an assembly worker can easily align the sound guiding hole with the circuit board hole so as to assemble the sound receiving structure 1. Furthermore, the size of the sound receiving channel formed by the sound guiding hole and the circuit board hole gradually decreases in size from an outer end to an inner end, and such gradually narrowing structure is capable of preventing distortion of a sound received. Moreover, the first buffer member and the second buffer member can provide a buffer effect and absorb noise, thus further ensuring the sound reception quality. In addition, the housing hole of the present invention is merely for accommodating the sound guiding tube rather than forming a sound receiving channel, and hence the airtightness between the housing hole and the sound guiding tube does not at all affect the sound reception quality.

What is claimed is:

1. A sound receiving electronic device, comprising:

a housing, defining a housing hole; and a sound receiving structure, for receiving a sound, comprising:

a circuit board, comprising:

a plate, defining a circuit board hole;

a sound guiding tube, provided above the plate and a side of the sound guiding tube disposed inside the housing hole, the sound guiding tube defining a sound guiding hole aligned with the circuit board hole, a diameter of the circuit board hole being smaller than a diameter of the sound guiding hole, wherein a diameter of the sound guiding tube is equal to a diameter of the housing hole, such that the sound guiding tube and the housing hole is fastened to each other; and a microphone, provided below the plate and corresponding in position to the circuit board hole, the sound being capable of passing through the sound guiding hole and the circuit board hole and then entering the microphone; and an accommodating structure, fastened to the housing, the accommodating structure and the housing forming an accommodating space therebetween for accommodating the circuit board.

2. The sound receiving electronic device as claimed in claim 1, wherein the sound receiving structure further comprises a blocking fabric connected to the housing and covering the housing hole.

3. The sound receiving electronic device as claimed in claim 2, wherein the sound receiving structure further comprises a first buffer member located between the circuit board and the housing.

4. The sound receiving electronic device as claimed in claim 3, wherein the sound receiving structure further comprises a second buffer member, the accommodating structure further comprises an accommodating structure bottom surface, and the second buffer member is located between the accommodating structure bottom surface and the circuit board.

5. The sound receiving electronic device as claimed in claim 4, wherein the second buffer member further comprises a recess in which the microphone is located.

6. The sound receiving electronic device as claimed in claim 5, wherein the sound receiving structure further comprises an adhesive layer, and the sound guiding tube is connected above the plate by using the adhesive layer.

7. The sound receiving electronic device as claimed in claim 6, wherein the accommodating structure further comprises an accommodating structure fastening hole and an accommodating structure fastening rod, the housing further comprises a housing fastening portion, and the accommodating structure fastening rod passes through the accommodating structure fastening hole and is fastened to the housing fastening portion.

8. A sound receiving structure, applied to a sound receiving electronic device to receive a sound, the sound receiving electronic device comprising a housing comprising a housing hole, the sound receiving structure comprising:

a circuit board, comprising:

a plate, defining a circuit board hole;

a sound guiding tube, provided above the plate and a side of the sound guiding tube disposed inside the housing hole, the sound guiding tube defining a sound guiding hole aligned with the circuit board hole, a diameter of the circuit board hole being smaller than a diameter of the sound guiding hole, wherein a diameter of the sound guiding tube is equal to a diameter of the housing hole, such that the sound guiding tube and the housing hole is fastened to each other; and a microphone, provided below the plate and corresponding in position to the circuit board hole, the sound being capable of passing through the sound guiding hole and the circuit board hole and then entering the microphone; and an accommodating structure, fastened to the housing, the accommodating structure and the housing forming an accommodating space therebetween for accommodating the circuit board.

9. The sound receiving structure as claimed in claim 8, further comprising a blocking fabric connected to the housing and covering the housing hole.

10. The sound receiving structure as claimed in claim 9, further comprising a first buffer member located between the circuit board and the housing.

11. The sound receiving structure as claimed in claim 10, further comprising a second buffer member, wherein the accommodating structure further comprises an accommodating structure bottom surface and the second buffer member is located between the accommodating structure bottom surface and the circuit board.

12. The sound receiving structure as claimed in claim 11, wherein the second buffer member further includes a recess in which the microphone is located.

13. The sound receiving structure as claimed in claim 12, further comprising an adhesive layer, wherein the sound guiding tube is connected above the plate by using the adhesive layer.

14. The sound receiving structure as claimed in claim 13, wherein the accommodating structure further comprises an accommodating structure fastening hole and an accommodating structure fastening rod, the housing further comprises a housing fastening portion, and the accommodating structure fastening rod passes through the accommodating structure fastening hole and is fastened to the housing fastening portion.

* * * * *